US005720536A

United States Patent [19]

Jenkins et al.

[11] Patent Number: 5,720,536

[45] **Date of Patent: *Feb. 24, 1998**

[54] REFRIGERATOR WITH IMPROVED BREAKER STRIP ASSEMBLY

[75] Inventors: Thomas Edward Jenkins, Louisville, Ky.; Thomas Charles Zimmer, Bloomington; Darrell Wayne Shewmaker, Georgetown, both of Ind.; Ronald Gary Foster, Louisville, Ky.

[73] Assignee: General Electric Company, Louisville, Ky.

[ * ] Notice: The term of this patent shall not extend beyond the expiration date of Pat. No. 5,584,551.

[21] Appl. No.: 410,860

[22] Filed: Mar. 27, 1995

[51] Int. Cl.[6] ..... A47B 81/00; E06B 7/16

[52] U.S. Cl. ..... 312/406.2; 312/407; 312/401

[58] Field of Search ..... 312/400, 401, 312/406, 407, 406.2, 406.1; 52/656.9, 665, 456, 656.8

[56] References Cited

U.S. PATENT DOCUMENTS

| | | | |
|---|---|---|---|
| 2,793,781 | 7/1957 | Morton | 312/406.2 X |
| 2,843,286 | 7/1958 | Pulaski . | |
| 3,380,615 | 4/1968 | Kessler | 312/406.2 X |
| 3,633,783 | 1/1972 | Aue . | |
| 4,134,627 | 1/1979 | Kuskowski . | |
| 4,665,676 | 5/1987 | Drzemala | 52/656.9 |
| 4,732,432 | 3/1988 | Keil et al. . | |
| 4,834,471 | 5/1989 | Pasqualini | 312/406.2 |
| 5,255,531 | 10/1993 | Williams et al. | 312/406.2 X |

FOREIGN PATENT DOCUMENTS

| | | | |
|---|---|---|---|
| 683739 | 12/1952 | United Kingdom | 312/406.2 |

*Primary Examiner*—Peter M. Cuomo
*Assistant Examiner*—Hanh V. Tran
*Attorney, Agent, or Firm*—H. Neil Houser

[57] ABSTRACT

A refrigerator cabinet has an outer case with lateral walls and a continuous front flange. A pair of liners are nested in the case and have lateral walls with a front edge positioned rearward of the case front flange. A resilient breaker strip connects the case walls to corresponding liner walls. The strip front wall extends inward from the case flange to a point inward of the liner wall and a side wall extends rearward to overlap the liner wall. A bifurcated edge of the strip receives the case flange. The strip side wall is return bent to form an inner wall engaging the inner surface and a resilient finger engaging the outer surface of the liner wall. A resilient mullion, connecting the adjacent inner lateral walls of the liners, has a front wall extending across the space between the liners and a side wall projecting rearward from each edge of the front wall to overlap the liner lateral wall. Each mullion side wall is return bent to form an inner wall engaging the inner surface and a resilient finger engaging the outer surface of the liner wall.

23 Claims, 4 Drawing Sheets

10
11
12
13
15
16
17
18
19
20
23
24
25
26
28
29
30
31
32
35
36
38
39
42
43
44
45
46
47
48
80

REFRIGERATOR WITH IMPROVED BREAKER STRIP ASSEMBLY

BACKGROUND OF THE INVENTION

The present invention relates to refrigerator cabinet structures and, more particularly, to breaker strip assemblies for joining the outer case and inner liners of such refrigerators. For some years breaker strip assemblies, of resilient insulation material, have been used to span the gap between the outer case and inner liner(s) of refrigerators. It will be understood that breaker strip assemblies are fully integrated and are very similar to unitary elements. Thus they tend to be interchangeably called "breaker strips" or "breaker strip assemblies". More recently such breaker strips have become larger, that is their front and side walls have become wider as a part of the effort to reduce the thermal losses through the case and door interface area. This is particularly true in refrigerators with both metal outer cases and metal inner liners, such as is typical in current day side-by-side refrigerator/freezer type refrigerators. See for example application U.S. Pat. No. 5,584,551 of Thomas Jenkins, assigned to General Electric Company assignee of the present invention, which is hereby incorporated herein by reference. That Patent discloses a cabinet and breaker strip assembly in which certain dimensions and relationships are optimized for minimal thermal loss.

It is desirable that there be a continuous seal between the breaker strip and both the outer case and the inner liners. It also is desirable that the breaker strip be reliably retained or connected to the case and liners. In addition it is desirable that the breaker strip, case and liners be easily assembled.

Therefore, it is an object of the present invention to provide an improved refrigerator cabinet structure with an improved breaker strip assembly.

It is another object of this invention to provide such a structure and assembly in which the breaker strip has a good, continuous seal with the outer case and inner liners.

It is still another object of this invention to provide such an improved structure and assembly in which the breaker strip assembly is reliably secured to the case and liners.

It is yet another object of this invention to provide such a structure and assembly in which the case, liners and breaker strip are easily assembled.

SUMMARY OF THE INVENTION

In accordance with one aspect of the present invention a refrigerator cabinet comprises an outer case with a lateral wall having an inwardly projecting front flange. The cabinet also comprises an inner liner received in the case and with a lateral wall having a front edge positioned rearward of the case front flange. A breaker strip of resilient insulation material connects the case and liner. The strip has a generally right angled cross-section with a front wall extending inward from the case lateral wall across the space between the case and liner lateral walls; and a side wall extending rearward from the front wall and overlapping the inner surface of the liner lateral wall. The breaker strip front wall has a bifurcated outer distal edge portion receiving the case lateral wall front flange. The rearward edge of the breaker strip side wall is return bent to form a forward projecting inner wall spaced outward of the breaker strip side wall and lying against the inner surface of the liner lateral wall. The forward edge of the inner wall is return bent to form a rearward projecting resilient finger engaging the outer surface of the liner lateral wall.

DETAILED DESCRIPTION OF PREFERRED EMBODIMENTS

Figures 1, 2:
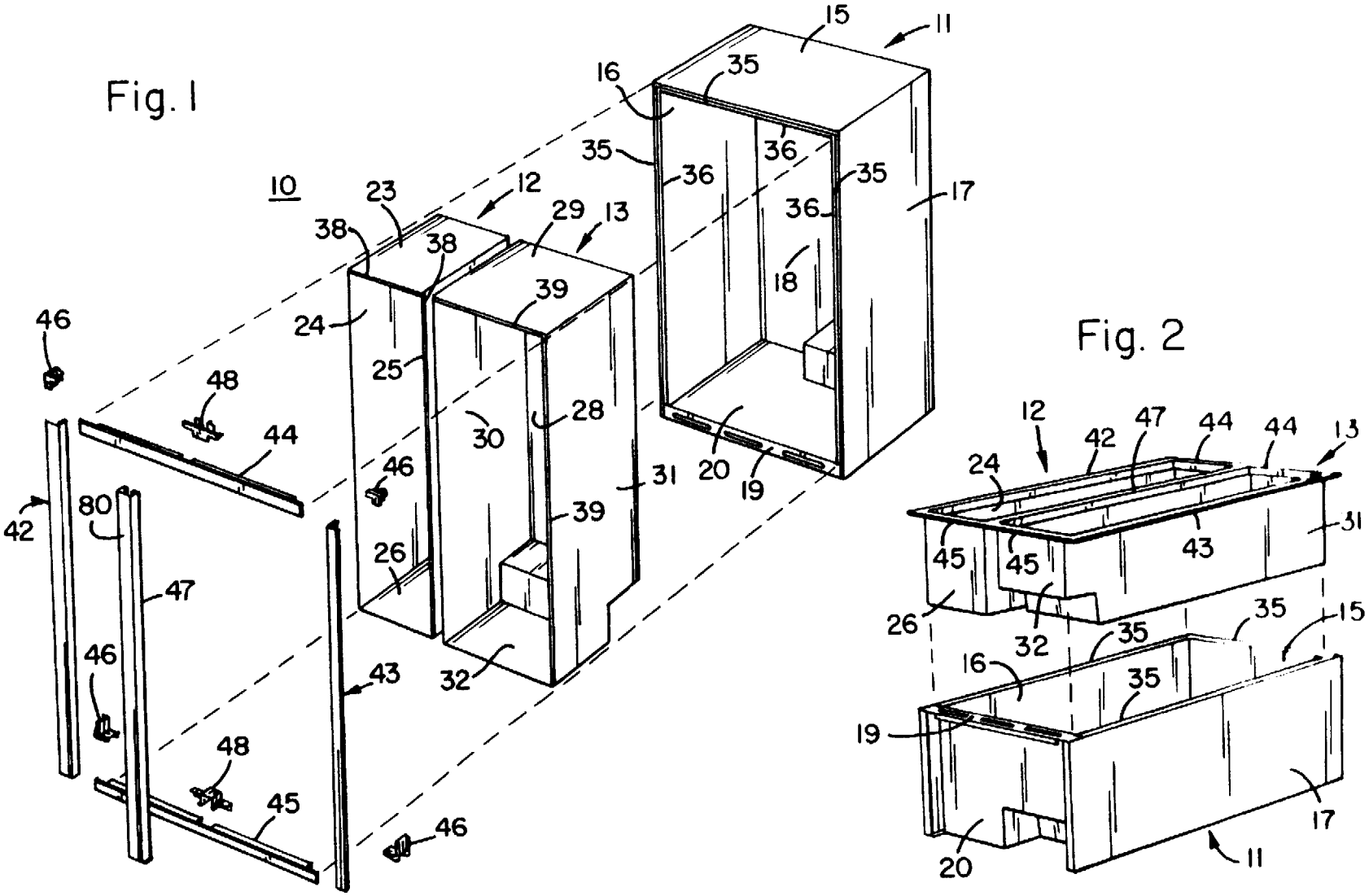
FIG. 1 is a simplified, exploded perspective view of the outer case, inner liners and breaker strip assembly of a side-by-side refrigerator.
FIG. 2 is a simplified, exploded perspective view of the refrigerator of FIG. 1, with the liner and breaker strip assembly separate from the case and with the case on its back.

FIG. 1 illustrates certain basic components of the cabinet for a side-by-side type refrigerator, that is one in which a freezer storage compartment and a fresh food storage compartment are arranged in a side-by-side relationship within the refrigerator. The refrigerator cabinet 10 includes an outer case 11 and inner liners 12,13 which form the freezer and fresh food compartments respectively. The liners 12,13 are received or nested within the case 11 in spaced apart relationship to the case and to each other and the space between these elements is filled with insulation 14 (see FIGS. 4–6), such as foamed in place polyurethane.

The outer case 11 conveniently is principally formed from a sheet of a suitable metal, such as pre-painted steel. The sheet is bent into an inverted U-shape forming the top 15, left side 16 and right side 17 walls of the case. The back wall 18 generally is added after various connections are made to the operating components of the refrigerator. The back wall normally is made from a much lighter material and sometimes it is even formed from a sheet of a heavy paper like material.

A heavy frame, including a front brace 19, is provided at the bottom of the refrigerator to support the cabinet and all the various operating components. The case bottom wall 20 often can be thinner than the metal sheet forming the top and sides. It generally is formed separately and then is attached to the sides 16,17 and to the frame, including front brace 19. However, if desired, the bottom wall 20 can be formed from the same sheet of metal as top wall 15 and side walls 16,17.

The lateral walls (that is the top 15, bottom 20 and sides 16,17), together with the back 18, form the open front outer case 11. It will be understood that, as generally used herein, "rearward", and other terms of similar import, refer to the direction from the open front of the cabinet toward the back wall 18; "forward", and other terms of similar import refer to the direction from the back wall 18 toward the open front; "inward", and other terms of similar import, refer to the directions from any of the lateral walls 15, 16, 17 and 20 toward the center of the case; and "outward", and other terms of similar import, refer to the directions from the center of case 11 toward any of the walls 15, 16, 17 or 20.

The freezer liner 12 has an open front, box-like configuration with a rear wall, not shown bounded by integral lateral walls, including top wall 23, left side wall 24, right side wall 25 and bottom wall 26. The front edges of the lateral walls 23–26 define the open front of the freezer compartment. The fresh food liner 13 has a similar open front, box-like configuration with a rear wall 28 bounded by integral top wall 29, left side wall 30, right side wall 31 and bottom wall 32. The front edges of the lateral walls 29–32 define the open front of the fresh food compartment. The lateral walls 23–26 and 29–32 of the liners 12,13 are narrower front-to-back than the lateral walls 15–17, 20 of the outer case 11. When the liners 12, 13 are nested within the case 11, the front distal edges of the liners are a substantial distance rearward of the front distal edge of the case. Currently most side-by-side refrigerators, such as the exemplification embodiment, are large capacity units and it is preferred to form the liners from sheet metal which is welded so that each liner is an unitary structure. However, other types of refrigerators, particularly smaller capacity units have liners molded from suitable plastic materials.

Figures 3, 4, 5, 6, 9:
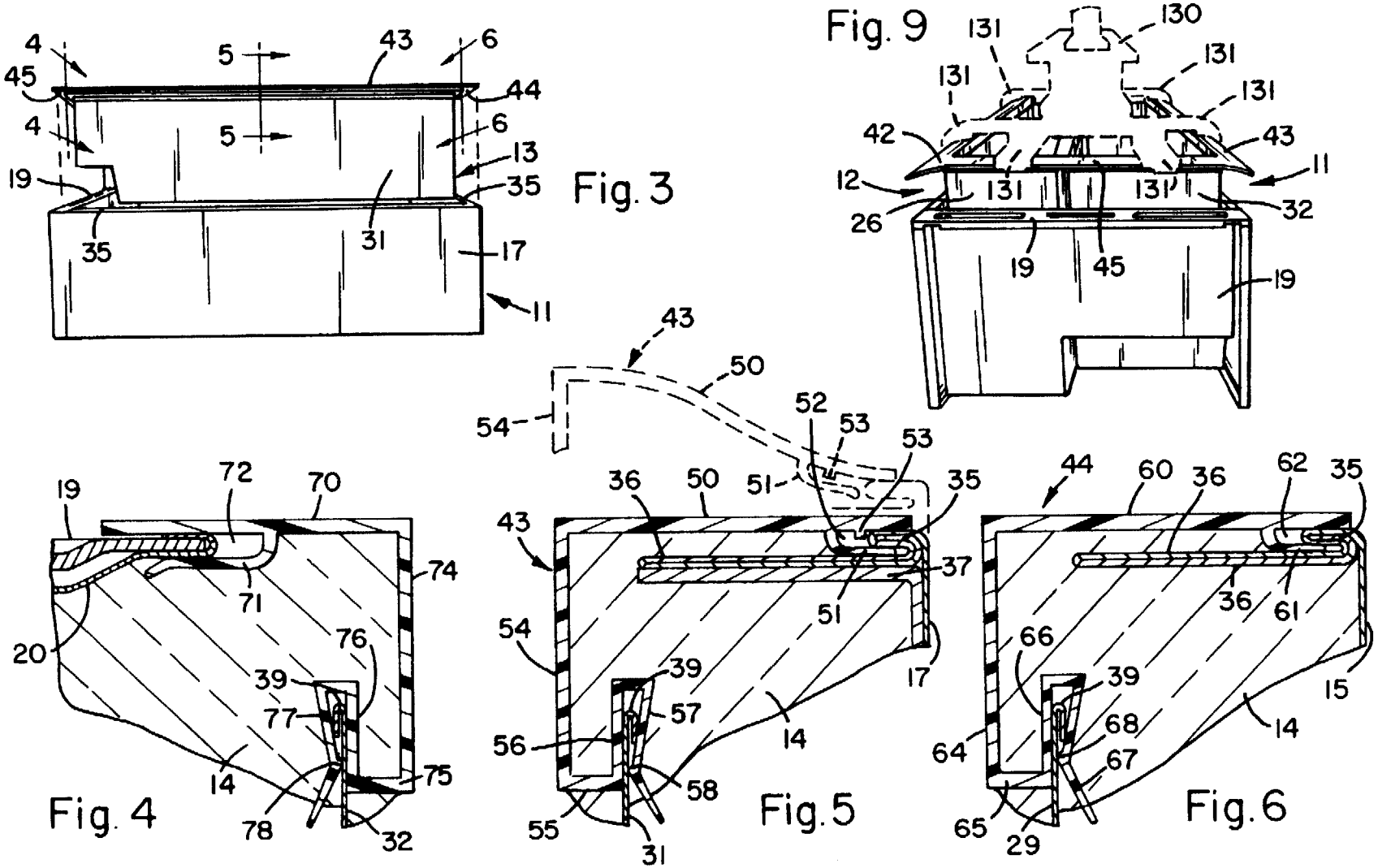
FIG. 3 is an exploded side elevation view similar to FIG. 2.
FIG. 4 is a fragmentary cross-sectional view of the bottom portion of the case, liner and breaker strip assembly generally as seen along line 4—4 in FIG. 3.
FIG. 5 is a fragmentary cross-sectional view of one side portion of the case, liner and breaker strip assembly generally as seen along line 5—5 in FIG. 3.
FIG. 6 is a fragmentary cross-sectional view of the top portion of the case, liner and breaker strip assembly generally as seen along line 6—6 in FIG. 3.
FIG. 9 is a simplified bottom perspective view of the refrigerator of FIG. 1, illustrating insertion of the liner/breaker strip assembly into the case.

Referring now to FIGS. 1, 5 and 6, the front portion of the metal sheet forming the top and side walls 15–17 of case 11 is return bent to provide a double thickness of metal. This double thickness portion then is bent to form a front flange 35 which projects inward a short distance around the front edge of substantially the entire length of top wall 15 and side walls 16,17. The double thickness portion is further bent to form a stiffening flange 36 which is positioned rearward of and projects inward farther than front flange 35 along its entire length. The front portion of the metal sheet normally is folded or bent into the double thickness and notches are cut where the corners will be located before the sheet is bent into its inverted U-shape. When the sheet then is bent, the lengths of the front flange and the stiffening flange along the top and side walls come together to form a continuous front flange 35 along the front edges of the top and sides and a continuous stiffening flange 36 slightly rearward of the front flange. If desired, the corners of the flanges can be welded to provide additional strength.

If desired, an elongated reinforcing member 37 is mounted against the inside of side walls 16,17 and the corresponding lengths of the stiffening flange 36 by suitable means such as welding. The reinforcing member adds additional stiffness and strength to the side walls 16,17 at the front of the case 11. This permits the use of an even thinner metal sheet to make the case while assuring that the openings to the storage compartments will remain square and that the doors closing the compartments will hang properly and completely seal the openings when they are closed. It will be understood that, if heavier material is used for the outer case 11, then the reinforcing members will not be needed and, usually no such reinforcing member is used along the top wall 15.

The front distal edge of each of the liners 12, 13 terminates well rearward of the outer case front flange 35 and somewhat to the rear of the stiffening flange 36. The front edge portion of the freezer liner 12 is return bent outwardly to form an outwardly disposed hook 38, that extends substantially completely around the front edge of the walls 23–26 of the liner 12. The front edge portion of fresh food liner 13 similarly is return bent outwardly to form an outwardly disposed hook 39, that extends substantially completely around the front edge of the walls 29–32 of the liner 13.

As discussed above, and as indicated in FIGS. 1 and 2, the inner liners 12,13 are mounted in outer case 11 in spaced apart relationship to the case and to each other. The space between each liner 12, 13 and the case 11, around the front of the refrigerator, is closed by a breaker strip assembly including elongated breaker strip side sections 42, 43, breaker strip top section 44 and breaker strip bottom section 45. Preferably, each section 42–45 is formed by a separate member or length of suitable insulation material. Each end of each side member 42, 43 is assembled to a corresponding end of the top member 44 and to a corresponding end of the bottom member 45 by corner members 46. The breaker strip assembly also includes an elongated mullion which closes the space between the inner side walls of liners 12, 13 at the front of the case 11. The mullion extends between the top member 44 and the bottom member 45 and is assembled to them by intermediate members 48. The various members of the breaker strip assembly are formed from a suitable flexible insulating material and conveniently can be molded of a suitable plastic such as, for example, an acrylo-butadiene-styrene (commonly referred to as ABS).

FIG. 3 illustrates the assembly in the orientation in which the liners are inserted into the case, rather than the orientation in which the refrigerator normally is used. That is, FIG. 3 shows the refrigerator back wall down rather than the bottom wall down. FIGS. 4–6 illustrate the cross-section configuration of the breaker strip side, top and bottom members and the manner in which they interact with the case 11 and liners 12,13. FIGS. 4–6 show the case, liner and breaker strip assembly as seen along the corresponding sight lines indicated in FIG. 3. Thus each of FIGS. 3–6 is ninety degrees away from the orientation of the illustrated components when the refrigerator is in use.

Referring particularly to FIG. 5, the breaker strip right hand side member 43 bridges the gap or space between outer case side wall 17 and fresh food liner side wall 31. Side member 43 includes a front wall 50 that overlaps the front flange 35 along outer case side wall 17 and extends inwardly to a position inside side wall 31 of liner 13. A flexible lip 51 is connected to the rearward side of front wall 50, extends outward along and spaced rearward of the distal outer edge portion of front wall 50 and is received between the front flange 35 and the adjacent stiffening flange 36. The outer case front flange 35 is held in the recess 52 between breaker strip front wall 50 and flexible lip 51. A dam 53 projects into recess 52 and extends axially of the front wall 50. The dam 53 controls how far into recess 52 the front flange 35 can project and thus controls the positioning of the breaker strip member 43 relative to outer case 11. ABS, from which the exemplification embodiment of breaker strip member 43 is molded, is sufficiently stiff that the length of recess 52 to make lip 57 sufficiently flexible to seal against flange 35 is greater than the width of front flange 35. If a more flexible material is used the lip can be made shorter and the dam omitted.

Side member 43 also includes a side wall 54 that projects rearwardly from the inner edge of the front wall 50 and overlaps the inner surface of liner side wall 31. At the rearward edge of the side wall 54, the member 43 is return bent to form a rear wall 55 which projects toward liner wall 31, parallel to and overlapping front wall 50. At the edge of rear wall 55 remote from side wall 54 the member 43 is return bent to form a forward projecting inner wall 56 which is parallel to and overlies side wall 54. In addition, the inner wall 56 lies against the inner surface of liner side wall 31. At the forward edge of inner wall 56, the member 43 is return bent to form a rearwardly projecting resilient finger 57 which overlaps the outer surface of liner wall 31. The finger 57 is formed with a hook 58 which engages the hook 39 formed adjacent the forward edge of liner wall 31.

The configuration of the member 43 assures that it is firmly assembled to the outer case 11 and to the liner 13. In addition it assures that insulation material will not leak between the member 43 and either the case or the liner during foaming of the insulation 14.

It will be understood that the construction of breaker strip side member 42 and its assembly to case 11 and liner 12 preferably is a mirror image of breaker strip 43. In fact the side members 42, 43 conveniently can be formed by extruding a substantial length of material and then cutting off sections of the desired length for each of the side members as they have the same cross-sectional shape, merely being turned end for end.

The breaker strip top member 44 bridges the gap or space between outer case top wall 15 and the top walls 23, 29 of the freezer and fresh food liners 12, 13 respectively. FIG. 6 illustrates the assembly of the top member 44 with case top wall 15 and top wall 29 of fresh food liner 13. It will be understood that the assembly with freezer liner 12 is the same. Top member 44 includes a front wall 60 that overlaps the front flange 35 along outer case top wall 15 and extends inwardly to a position inside top wall 29 of liner 13. A flexible lip 61 is connected to the rearward side of front wall 60, extends outward along and spaced rearward of the distal outer edge of front wall 60 and is received between the front flange 35 and the adjacent stiffening flange 36. The outer case front flange 35 is held in the recess 62 between breaker strip front wall 60 and flexible lip 61. In contrast to the side members 42, 43 and as will be discussed in more detail hereafter, no dam extends into the recess 62.

Top member 44 also includes a side wall 64 that projects rearwardly from the inner edge of the front wall 60 and overlaps the inner surface of liner top wall 29. At the rearward edge of the side wall 64, the member 44 is return bent to form a rear wall 65 which projects toward liner wall 29, parallel to and overlapping front wall 60. At the edge of rear wall 65 remote from side wall 64 the member 44 is return bent to form a forward projecting inner wall 66 which is parallel to and overlies side wall 64. In addition, the inner wall 66 lies against the inner surface of liner top wall 29. At the forward edge of inner wall 66, the member 44 is return bent to form a rearwardly projecting resilient finger 67 which overlaps the outer surface of liner wall 29. The finger 67 is formed with a hook 68 which engages the hook 39 formed adjacent the forward edge of fresh food liner wall 29.

In a like manner, the distal or forward edge of freezer liner top wall 23 is received in the corresponding portion of the recess formed between inner wall 66 and resilient finger 67 and the corresponding portion of hook 68 engages hook 38 formed adjacent the forward edge of wall 23.

The configuration of the member 44 assures that it is firmly assembled to the outer case 11 and to the liners 12, 13. In addition it assures that insulation material will not leak between the member 44 and either the case or the liners during foaming of the insulation 14. It will be understood that breaker strip top members 44 conveniently may be formed by extruding a substantial length of material and then cutting off a section of the desired length for each top member.

The breaker strip bottom member 45 bridges the gap or space between outer case bottom wall 20, the front brace 19, and the bottom walls 26,32 of the fresh food liners 12,13. FIG. 4 illustrates the assembly of the breaker strip bottom member 45 with the front brace 19, and case bottom wall 20, and bottom wall 32 of fresh food liner 13. It will be understood that the assembly with the brace 19, case bottom wall 20 and freezer liner 12 is the same. Bottom member 45 includes a front wall 70 that overlaps the front brace 19 and the case bottom wall 20, which is bent around the upper edge of brace 19. The bottom member front wall 70 extends inwardly to a position inside bottom wall 32 of liner 13. A flexible lip 71 is connected to the rearward side of front wall 70, extends outward along and spaced rearward of the distal outer edge portion of front wall 70 and overlaps the rear side of front brace 19. The front brace is held in the recess 72 between breaker strip front wall 70 and flexible lip 71. As will be discussed in more detail hereafter, no dam extends into the recess 72 and recess 72 is significantly wider or deeper than recess 62 associated with breaker strip top member 44.

Bottom member 45 also includes a side wall 74 that projects rearwardly from the inner edge of the front wall 70 and overlaps the inner surface of liner 13 bottom wall 32. At the rearward edge of the side wall 74, the member 45 is return bent to form a rear wall 75 which projects toward liner wall 32, parallel to and overlapping front wall 70. At the edge of rear wall 75 remote from side wall 74 the member 45 is return bent to form a forward projecting inner wall 76 which is parallel to and overlies side wall 74. In addition, the inner wall 76 lies against the inner surface of liner bottom wall 32. At the forward edge of inner wall 76, the member 45 is return bent to form a rearwardly projecting resilient finger 77 which overlaps the outer surface of liner wall 32. The finger 77 is formed with a hook 78 which engages the hook 39 formed adjacent the forward edge of liner wall 32.

The configuration of the member 45 assures that it is firmly assembled to the front brace and outer case outer case 11 and to the liner 13. In addition it assures that insulation material will not leak between the member 45 and either the case or the liner during foaming of the insulation 14. It will be understood that breaker strip bottom members 45 conveniently are formed by extruding a substantial length of material and then cutting off a section of the desired length for each bottom member.

The mullion 47 is, in effect, a breaker strip member with a front wall and a pair of spaced apart side wall. More particularly, and viewing FIGS. 1 and 7, the mullion 47 includes a front wall 80 that spans the space between the inner side wall 25 of liner 12 and inner side wall 30 of liner 13. A side wall 81 projects rearwardly from one lateral edge of front wall 80 and overlaps the inner surface of side wall 30 of liner 13. At the rearward edge of the side wall 81, the mullion 47 is return bent to form a rear wall 82 which projects toward liner wall 30, parallel to and overlapping front wall 80. At the edge of rear wall 82 remote from side wall 81 the mullion 47 is return bent to form a forward projecting inner wall 83 which is parallel to and overlies side wall 81. In addition, the inner wall 83 lies against the inner surface of liner side wall 30. At the forward edge of inner wall 83, the mullion 47 is return bent to form a rearwardly projecting resilient finger 84 which overlaps the outer surface of liner wall 30. The finger 84 is formed with a hook 85 which engages the hook 39 formed adjacent the forward edge of liner wall 30.

Another side wall 86 projects rearwardly from the other lateral edge of front wall 80 and overlaps the inner surface of side wall 25 of liner 12. At the rearward edge of the side wall 86, the mullion 47 is return bent to form a rear wall 87 which projects toward liner wall 25, parallel to and overlapping front wall 80. At the edge of rear wall 87 remote from side wall 86 the mullion 47 is return bent to form a forward projecting inner wall 88 which is parallel to and overlies side wall 86. In addition, the inner wall 88 lies against the inner surface of liner side wall 25. At the forward edge of inner wall 88, the mullion 47 is return bent to form a rearwardly projecting resilient finger 89 which overlaps the outer surface of liner wall 25. The finger 89 is formed with a hook 90 which engages the hook 39 formed adjacent the forward edge of liner wall 25.

The configuration of the mullion 47 assures that it is firmly assembled to the liners 12, 13. In addition it assures that insulation material will not leak between the mullion 47 and either of the liners during foaming of the insulation 14. It will be understood that mullions 47 conveniently are formed by extruding a substantial length of material and then cutting off a section of the desired length for each mullion. In addition the mullion preferably is symmetric about its longitudinal axis so that the individual lengths can be used in either of their orientations.

Figures 7, 8:
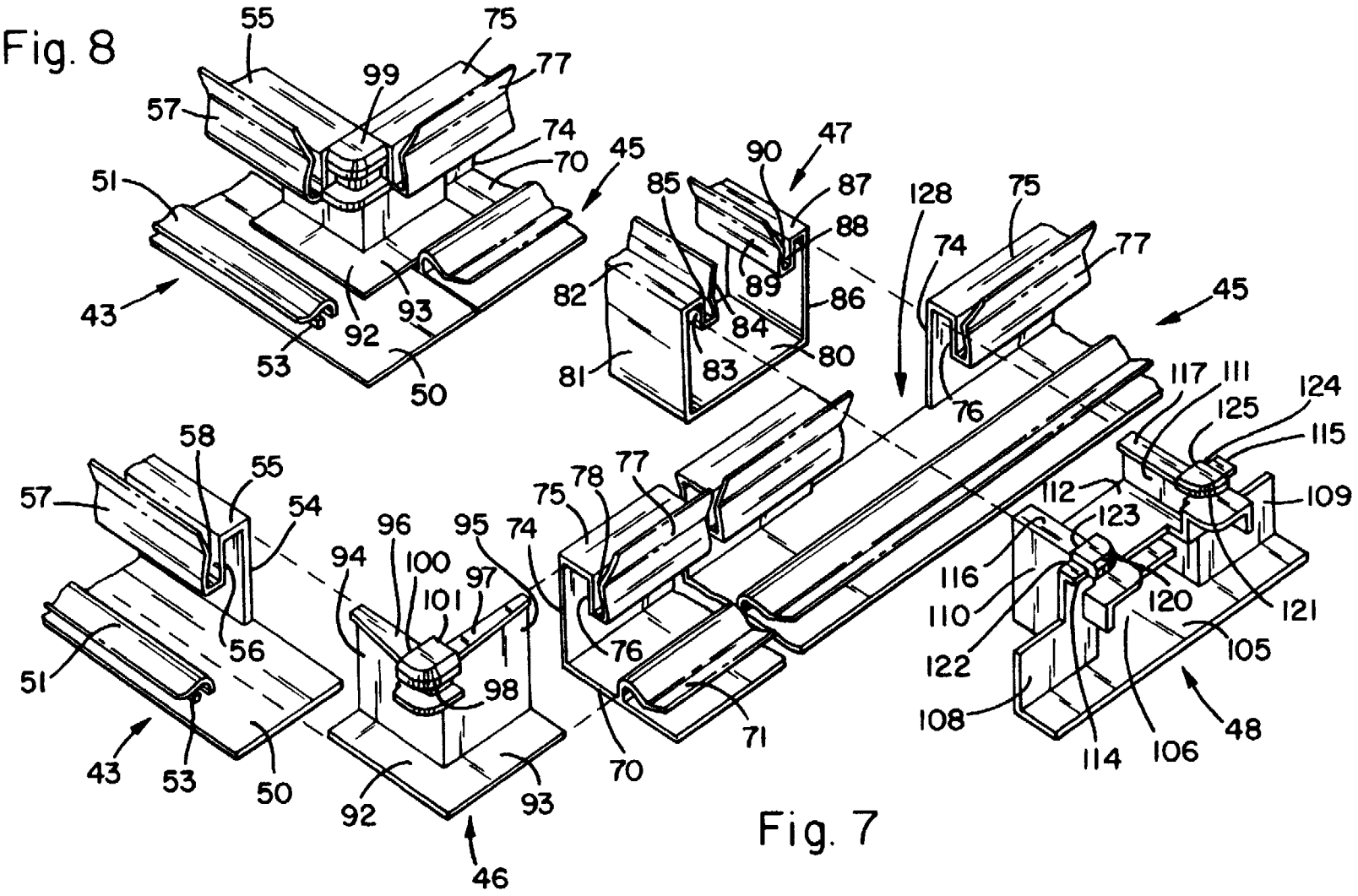
FIG. 7 is an exploded perspective view illustrating assembly of a breaker strip side member, bottom member and mullion with a corner member and an intermediate member.
FIG. 8 is a perspective view of the breaker strip side member, bottom member and corner member of FIG. 7, shown in their assembled configuration.

Referring to FIGS. 1, 7 and 8, it will be seen that a complete breaker strip is assembled using corner members 46 and intermediate members 48. Only the portion of the breaker strip assembly has been illustrated which shows the connection of side member 43 and bottom member 45 with a corner member 46 and the connection of bottom member 45 and mullion 47 with intermediate member 48. It will be understood that conveniently each connection of each side member with each of the top and bottom members is the same and each of the connections of the mullion with each of the top and bottom members is the same.

Each of the corner members and intermediate members is an unitary structure preferably molded of a suitable insulation material such as a plastic like ABS. Each corner member includes a pair of front walls 92, 93 extending perpendicularly from each other in a common plane. A pair of side walls 94, 95 project rearwardly from and perpendicular to the inner edges of front walls 92, 93 respectively and extend perpendicularly from each other. A pair of rear walls 96, 97 project perpendicularly from the rear edge of the side walls 94, 95 respectively and overlie the front walls 92, 93 respectively. Each corner member includes a shoulder portion 98 at the junction of walls 94, 95 and 96, 97. The shoulder portion 98 includes a pair of transverse walls 100, 101 which are perpendicular to each other and project perpendicularly rearward from the inner end of rear walls 96, 97 respectively.

As seen from FIG. 7, the corner member 46 is connected to or assembled with a side member and the adjacent top or bottom member. The walls 92, 94 and 96 of corner member 46 fit against the walls 50, 54 and 55 of side member 43 and corner member walls 93, 95 and 97 fit against the walls 70, 74 and 75 of bottom member 45. The walls 96, 97 are tapered from their junctions with shoulder portion 98 toward their distal ends so that they will easily fit between walls 54, 56 and 74, 76 respectively as the members are moved together and then will fit tightly between these sets of walls when fully seated. In addition the distal end of side member rear wall 55 and bottom member rear wall 75 engage the transverse walls 100,101 respectively of corner member shoulder portion 99. The corner member bridges the gap between the adjacent side and bottom member and assures a sturdy corner and no leaking of the insulation. Side member 43, bottom member 45 and corner member 46 are shown in their fully assembled configuration in FIG. 8.

If desired the side, rear and inner wall of either the side member 43 or of the bottom member 45 is removed adjacent the end of that member for a distance equal to the width of the other member. This enables that member to completely overlap the corner member so that the side and bottom members form a complete butt joint. In FIG. 7 the side member 43 is shown with the portion of walls 54, 55, 56 and 57 removed.

It will be understood that the other three corners of the breaker strip assembly preferably are constructed and assembled in the same way. The other corners have not been shown for the sake of simplicity.

FIG. 7 also illustrates an intermediate member 48 connecting the bottom member 45 with the mullion 47. The intermediate member has a planar front wall including a first section 105 with a second section 106 projecting perpendicularly from one lateral edge of the first section at its mid point so that the front wall is T shaped. First and second side walls 108, 109 project perpendicularly from that lateral edge of the first front wall section 105 on either side of the second front wall section 106. Third and fourth side walls 110, 111 project perpendicularly from the lateral edges of second front wall section 106 and join the first and second side walls 108, 109 respectively. A reinforcing web 112 extends between side walls 110, 111. Short rear walls 114, 115 are formed along the edges of side walls 108, 109 respectively remote from first front wall section 105. Similarly, rear walls 116, 117 are formed along the edges of side walls 110, 111 respectively remote from second front wall section 106. Shoulder portions 120, 121 are provided at the junctions of side walls 108, 110 and 109, 111 respectively. Shoulder portion 120 includes transverse walls 122, 123 which project rearwardly of rear walls 114, 116 respectively. Shoulder portion 121 includes transverse walls 124, 125 which project rearwardly of rear walls 115, 117 respectively.

A portion of each of the bottom member side wall 74, rear wall 75, inner wall 76 and flexible finger 77 are removed or cut out at the location where the mullion 47 is joined to the bottom member 45, as indicated at 128, and the second section of the intermediate member 48 extends through the removed portion or cutout 128. The front wall first section 105 rests against the front wall 70 of bottom member 45, with side walls 108, 109 against side wall 74 on each side of cutout 128 and rear walls 114, 115 against rear wall 75 on each side of cutout 128. The second front wall section 106 of intermediate member 48 rests against front wall 80 of mullion 47, with side walls 110, 111 against side walls 81, 86 and rear walls 116, 117 against rear walls 82, 87. The distal ends of the bottom member and mullion rear walls engage the transverse walls 122–125, respectively. The intermediate member 48 bridges the gap between the bottom wall 45 and the mullion 47 and assures a sturdy joint and no leaking of the insulation.

Preferably, the assembly of the mullion 47 with the top member 44 is accomplished in the same manner with another intermediate member 48. The top assembly has not been shown for purposes of simplicity.

Referring now to FIGS. 2 and 7, in assembling the exemplification side-by-side refrigerator the breaker strip is assembled and then is assembled or connected to both of the inner liners so that the lateral walls of the liners are secured between the inner walls and flexible fingers of the breaker strip side, top and bottom members and of the mullion, with the hooks of the corresponding members engaged or overlapping as previously described. The inner liner/breaker strip sub-assembly then is fairly stable and can be handled as a unit. The outer case 11 is formed and placed on its back wall 18 so that its open front faces upward. The inner liner/breaker strip sub-assembly is then lowered into the case and the outer distal edges of the breaker strip side, top and bottom walls engage the front flange 35 and front brace 19 so that the flange and brace are received within the recesses between the breaker strip front walls and the corresponding resilient lips. FIG. 2 shows a side-by refrigerator with the liner/breaker strip sub-assembly above the case, ready for insertion.

The inner liner/breaker strip sub-assembly conveniently is placed in the case 11 by a machine and FIG. 9 shows the sub-assembly held by machine 130. The arms 131 of the machine flex the breaker strip front walls 50, 60 and 70 downwardly. (Breaker strip side member 43 is shown in its flexed position in dashed line in FIG. 5.) The sub-assembly is then inserted into the outer case and the flange 35 on each side of the case is received in the recess 52 at the outer edge of the breaker strip side members 42, 43. In the exemplification embodiment the ribs 53 accurately position the sub-assembly side-to-side. The sub-assembly is pushed toward the bottom of the case so that the front brace 19 is received in the recess 72 and substantially fills the recess. This provides clearance so that the top portion of front flange 35 can clear resilient lip 61 of breaker strip top member 44. Then the subassembly is moved toward the top of the case to seat the top portion of flange 35 in recess 62 on the rear side of member 44. The liner, breaker strip and case then are fully seated and a suitable insulation is foamed in place.

In some side-by-side refrigerators it may desirable to have thicker insulation between the freezer storage compartment top and outer side walls 23, 24 and the corresponding case walls than between the fresh food storage compartment top and outer side walls 29, 31 and the case. This will conserve energy by reducing the heat transfer of the freezer. However, it will result in a smaller freezer compartment than otherwise would be possible in a cabinet of a given size. The difference in the side wall insulation thickness can most easily be accomplished by using strips 42, 43 which differ in certain dimensions, principally in the width of the rear wall. Specifically, rear wall 55 (see FIG. 5) of the fresh food breaker strip side member 43 will be wider than the corresponding rear wall of the breaker strip side member 42 so that the fresh food compartment will be closer to the side wall of the outer case.

Figure 10:
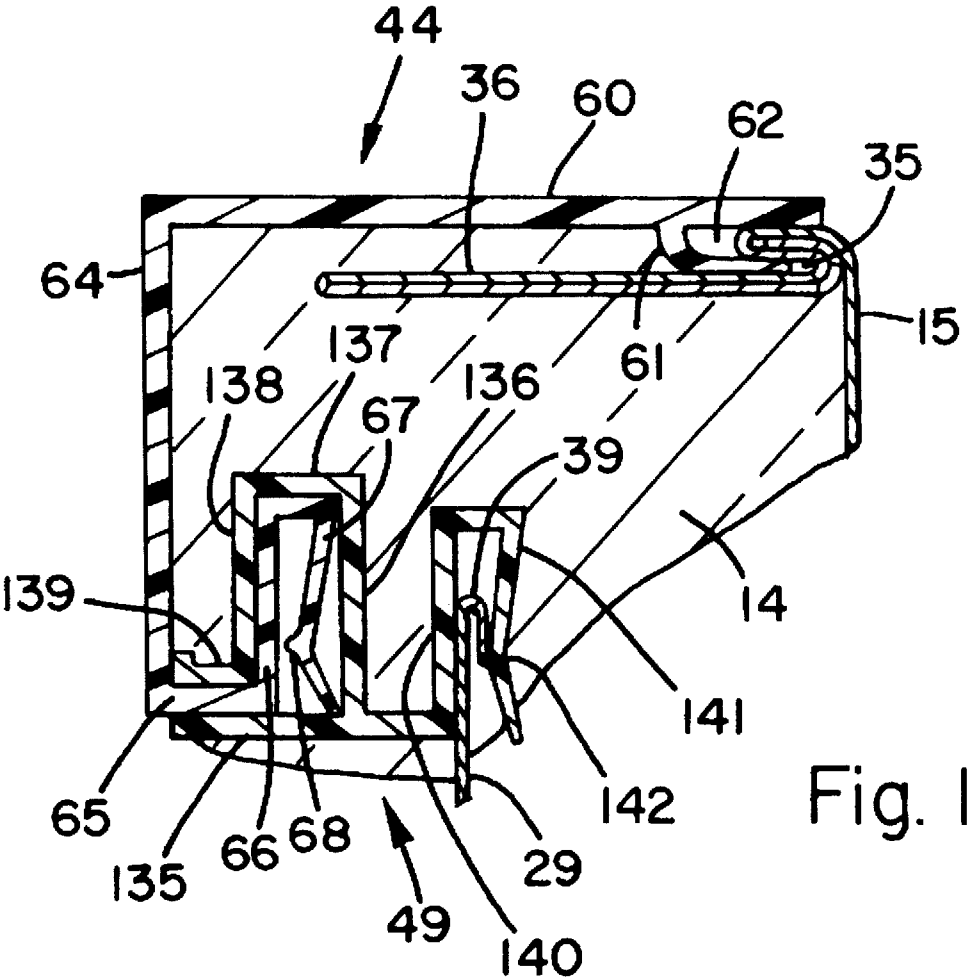
FIG. 10 is a fragmentary cross-sectional view of the top portion of the case, liner and breaker strip assembly similar to FIG. 6 but showing a modified embodiment of the invention.

The breaker strip top member 44 could be divided into two separate pieces with different width rear walls. However, this would result in a multi-part seam where the top members and the mullion 47 are joined by intermediate member 48. Such a construction may result in some unsightly leakage of the foam insulation 14 at the joint. Viewing FIG. 10, there is illustrated a modified construction in which a spacer member 49 bridges between the breaker strip top member 44 and the front edge of the top wall 29 of the fresh food liner 13. The top member 44 is the same as previously described and like numerals have been used to refer to like portions. The spacer member 49 includes a rear wall 135 which overlies the rear wall 65 of member 44 and projects upwardly toward outer case top wall 15. An intermediate side wall 136 projects forward of the rear wall 135 adjacent the resilient finger 67. The forward edge of the intermediate side wall 136 is return bent to form a rearward projecting inner side wall 138 that overlies the inner wall 66 of breaker member 44. The rear edge of the inner side wall 138 is formed with a foot 139 that seats against the outer surface of breaker member rear wall 65 and fits closely between breaker member side wall 65 and inner wall 66. This construction firmly connects the spacer member 49 to breaker member 44 so that it functions as an integral portion the member 44. At the upper or distal edge of the rear wall 135 the spacer member is bent to form a forward projecting outer side wall 140. At the forward edge of the wall 140, the member 49 is return bent to form a rearwardly projecting resilient finger 141 which overlaps the outer surface of the wall 140. The finger 141 is formed with a hook 142 which engages the hook 39 formed adjacent the forward edge of the fresh food liner top wall 29.

The spacer member is attached to and effectively becomes a part of the top breaker member 44 in register with the top of the fresh food liner 13. It enables the fresh food liner to extend above the top of the freezer liner, with a thinner layer of insulation between the top of the fresh food liner 13 and the case 11 than between the top of the freezer liner 12 and the case 11.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator cabinet comprising:

an outer case having a lateral wall with an inwardly projecting front flange;

an inner liner received within said case and including a lateral wall spaced inward of said case lateral wall, said liner lateral wall having a front edge positioned rearward of said front flange;

a breaker strip of resilient insulation material connecting said case and liner, said breaker strip having a generally right angled cross-section with a front wall extending inward from said case lateral wall across the space between said case lateral wall and said liner lateral wall and a side wall extending perpendicularly rearward from said front wall and overlapping the inner surface of said liner lateral wall;

said breaker strip front wall including a bifurcated distal edge portion receiving said case front flange; and said breaker strip side wall being return bent along its rearward edge to form an inner wall spaced outward of said side wall and lying against the inner surface of said liner lateral wall, said inner wall being return bent along its forward edge to form a rearward projecting resilient finger engaging the outer surface of said liner lateral wall.

2. A refrigerator cabinet as set forth in claim 1, wherein: said bifurcated distal edge portion of said breaker strip front wall is formed by a flexible lip which is attached to the said front wall and extends outwardly along and spaced to the rear of said front wall distal edge portion.

3. A refrigerator cabinet as set forth in claim 2, further comprising; a dam projecting into the space between said front wall distal edge portion and said lip at a predetermined position to control the depth to which said outer case front flange is received into said breaker strip front wall bifurcated distal edge portion.

4. A refrigerator as set forth in claim 1, wherein: said front edge of said liner lateral wall is outwardly return bent and said breaker strip resilient finger includes a hook having an interference fit with said return bent front edge of said liner lateral wall.

5. A refrigerator cabinet as set forth in claim 4, wherein: said bifurcated distal edge portion of said breaker strip front wall is formed by a flexible lip which is attached to and extends outwardly along and spaced to the rear of said front wall distal edge portion.

6. A refrigerator cabinet as set forth in claim 5, further comprising; a dam projecting into the space between said breaker strip front wall distal edge portion and said lip at a predetermined position to control the depth to which said case front flange is received in the space between said front wall and said corresponding flexible lip.

7. A refrigerator cabinet comprising:

an outer case including spaced apart side walls connected by a top wall, each of said side and top walls including an inwardly projecting front flange forming a substantially continuous outer case front flange:

an open front inner liner positioned within said outer case and including spaced apart side walls connected by a top wall, each of said liner side and top walls having a front edge positioned rearward of said outer case front flange;

a breaker strip connecting said case and said liner, said breaker strip including breaker strip sections of resilient insulation material, each of said sections having a generally right angled cross-section including a front wall extending inward from said front flange of the corresponding one of said case side and top walls to a position inward of the corresponding one of said liner side and top walls; each of said breaker strip sections also including a side wall extending rearward from its front wall to a position overlapping the inner surface of said corresponding one of said liner side and top walls;

each of said breaker strip section front walls including a bifurcated distal edge portion receiving said front flange of said corresponding one of said case side and top walls; and each of said breaker strip section side walls being return bent at its rearward edge to form an inner wall spaced outward from that breaker strip section side wall and lying against inner surface of said corresponding one of said liner side and top walls, each of said inner walls being return bent at its forward edge to form a rearward projecting resilient finger engaging the outer surface of said corresponding one of said liner side and top walls.

8. A refrigerator cabinet as set forth in claim 7, wherein:

said case also has a bottom wall with an inward projecting front flange forming part of said case front flange;

said liner also has a bottom wall with a front edge positioned rearward of said outer case front flange;

said breaker strip also includes a bottom section having a generally right angled cross-section including a front wall extending inward from said case bottom wall front flange to a position inward of said liner bottom wall; said breaker strip bottom section also having a side wall extending rearward from said bottom section front wall to a position overlapping the inner surface of said liner bottom wall;

said breaker strip bottom section front wall includes a bifurcated distal edge portion receiving said case bottom wall front flange; and said breaker strip bottom section side wall is return bent at its rearward edge to form an inner wall spaced outward of said bottom section side wall and lying against the inner surface of said liner bottom wall and said bottom section inner wall is return bent at its forward edge to form a rearward projecting resilient finger engaging the outer surface of said liner bottom wall.

9. A refrigerator cabinet as set forth in claim 7, wherein: said bifurcated distal edge portion of each of said breaker strip section front walls is formed by a flexible lip which is attached to that front wall and extends outwardly along and spaced to the rear of that front wall distal edge portion.

10. A refrigerator cabinet as set forth in claim 9, further comprising: a dam projecting into the space between said front wall distal edge portion of each breaker strip section connecting a case side wall and a liner side wall and said corresponding lip at a predetermined position to control the depth to which said corresponding case side wall front flange is received into said bifurcated edge portion of said breaker strip section front wall.

11. A refrigerator as set forth in claim 7, wherein: said liner side and top walls are return bent outward and said corresponding breaker strip section side wall resilient fingers include hooks having an interference fit with said return bent outer edges of said liner side and top walls.

12. A refrigerator cabinet, comprising:

an outer case including spaced apart side walls connected by a top wall, each of said side and top walls including an inwardly projecting front flange forming a substantially continuous outer case front flange;

a pair of open front liners received in said case in spaced apart relationship to each other and to said case; each of said liners having spaced apart inner and outer side walls connected by a top wall; each of said liner side and top walls having a front edge positioned rearward of said outer case front flange;

a breaker strip connecting said case side and top walls with the corresponding outer side and top walls of said liners; said breaker strip including breaker strip sections of resilient insulation material having a generally right angled cross-section, each of said sections including a front wall extending inward from said front flange of the corresponding one of said case side and top walls to a position inward of the corresponding one of said liner outer side walls and top wall; each of said breaker strip sections also including a side wall extending rearward from its front wall to a position overlapping the inner surface of said corresponding one of said liner outer side walls and top wall;

each of said breaker strip section front walls including a bifurcated distal edge portion receiving said front flange of said corresponding one of said case side walls and top wall;

each of said breaker strip section side walls being return bent along its rearward edge to form an inner wall spaced outward from that breaker strip section side wall and lying against the inner surface of said corresponding one of said liner outer side walls and top wall, each of said inner walls being return bent along its forward edge to form a rearward projecting resilient finger engaging the outer surface of said corresponding one of said liner outer side walls and top wall; and an elongated mullion of resilient insulation material including a front wall lying substantially in the plane of said breaker strip front walls and extending from inside one liner inner side wall to inside the other liner inner side wall, said mullion also including spaced apart side walls extending from the lateral edges of said mullion front wall to positions overlapping the inner side wall of the corresponding liner; each of said mullion side walls being return bent along its rearward edge to form an inner wall spaced from that mullion side wall and lying against the inner surface of the corresponding one of said liner inner side walls, each of said mullion inner walls being returned bent along its forward edge to form a rearward projecting resilient finger engaging the outer surface of said corresponding liner inner side wall.

13. A refrigerator cabinet as set forth in claim 12, wherein: said bifurcated distal edge portion of each of said breaker strip front walls is formed by a flexible lip which is attached to that front wall and extends outwardly along and spaced to the rear of that front wall distal edge portion.

14. A refrigerator cabinet as set forth in claim 13, further comprising: a dam projecting into the space between said front wall distal edge portion of each breaker strip section connecting a case side wall and a liner outer wall and said corresponding lip at a predetermined position to control the depth to which said corresponding case side wall front flange is received into said bifurcated edge portion of said breaker strip front wall.

15. A refrigerator as set forth in claim 12, wherein: said front edges of said side and top walls of each of said liners are return bent away from the inside of that liner and said breaker strip side wall resilient fingers and said mullion side wall resilient fingers include hooks having an interference fit with corresponding ones of said return bent edges of said liner side and top walls.

16. For use in a refrigerator cabinet, a breaker strip assembly comprising:

a pair of elongated breaker strip side members and an elongated breaker strip top member;

each of said top and side members being an unitary structure having an elongated front wall; an elongated side wall projecting perpendicularly from one lateral edge of said front wall; an elongated rear wall projecting perpendicularly from the lateral edge of said side wall remote from said front wall and overlying said front wall; an elongated inner wall projecting perpendicularly from the lateral edge of said rear wall remote from said side wall and overlying said side wall;

right angled corner members for joining one end of each of said side members to a corresponding end of said top member; each of said corner members being an unitary structure including a pair of front walls extending generally perpendicularly from each other in a common plane; a pair of side walls extending generally perpendicularly from each other, each of said side walls projecting generally perpendicularly from the inner lateral edge of a corresponding one of said front walls; and a pair of rear walls each of said rear walls projecting generally perpendicularly from a corresponding side wall and overlying a corresponding front wall;

each of said corner members being assembled to one end of a corresponding one of said side members and to a corresponding end of said top member with one joined set of said corner member front, side and rear walls fitted within said front, side, rear and inner walls of one of said corresponding side and top members and with the other joined set of front, side and rear walls of said corner member being fitted within said front, side, rear and inner walls of the other of said corresponding side and top members.

17. A breaker strip assembly as set forth in claim 16, wherein: a length of said side, rear and inner walls of one of said top and side members adjacent each corner member substantially equal to the width of the adjacent front wall of the other of said top and side member is omitted so that said top and side members form a butt joint when assembled to said corner member.

18. A breaker strip as set forth in claim 16, wherein: each of said corner members includes a shoulder portion adjacent said corner member rear walls and engaging said rear walls of said corresponding top and side members when said corner member is assembled to said corresponding top and side members.

19. A breaker strip assembly as set forth in claim 16, further including:

an elongated breaker strip bottom member and additional right angled corner members for joining the other end of each side member to a corresponding end of said bottom member;

said bottom member being an unitary structure including an elongated front wall; an elongated side wall projecting perpendicularly from one lateral edge of said front wall; an elongated rear wall projecting perpendicularly from the lateral edge of said side wall remote from said front wall and overlying said front wall; an elongated inner wall projecting perpendicularly from the lateral edge of said rear wall remote from said side wall and overlying said side wall;

each of said additional corner members being an unitary structure including a pair of front walls extending generally perpendicularly from each other in a common plane; a pair of side walls extending generally perpendicularly from each other, each of said side walls projecting generally perpendicularly from the inner lateral edge of a corresponding one of said front walls; and a pair of rear walls each of said rear walls projecting generally perpendicularly from the lateral edge of a corresponding side wall remote form the corresponding front wall and overlying said corresponding front wall;

each of said additional corner members being assembled to one end of a corresponding one of said side members and to a corresponding end of said bottom member with one joined set of said additional corner member front, side and rear walls fitted within said front, side, rear and inner walls of one of said corresponding side and bottom members and with the other joined set of front, side and rear walls of said additional corner member being fitted within said front, side, rear and inner walls of the other of said corresponding side and bottom members.

20. A breaker strip assembly as set forth in claim 19, wherein: a length of said side, rear and inner walls of one of said bottom and side members adjacent each additional corner member, substantially equal to the width of the adjacent front wall of the other of said bottom and side members, is omitted so that said bottom and side members form a butt joint when assembled to said corner member.

21. A breaker strip as set forth in claim 18, wherein: each of said additional corner members includes a shoulder portion adjacent said additional corner member rear walls and engaging said rear walls of said corresponding top and side members when said corner member is assembled to said corresponding top and side members.

22. A breaker strip assembly as set forth in claim 18, further including:

an unitary elongated mullion extending between said top and bottom breaker strip members and positioned intermediate said breaker strip side members; said mullion including an elongated front wall; a pair of elongated side walls projecting perpendicularly from the lateral edges of said front wall; an elongated rear wall projecting from the lateral edge of each side wall remote from said front wall and overlying said front wall; an elongated inner wall projecting perpendicularly from the lateral edge of each rear wall remote from the corresponding side wall and overlying said corresponding side wall; a length of said side, rear and inner walls of each of said breaker strip top and bottom members, substantially equal to the width of said mullion, being omitted where said mullion meets each of said top and bottom members;

a pair of intermediate members for joining the ends of said mullion to said top and bottom breaker strip members; each of said intermediate members being an unitary structure including a planar front wall with a first elongated section and a second elongated section projecting perpendicularly from an intermediate portion of one lateral edge of said first section; an elongated second section side wall projecting perpendicularly from each lateral edge of said second front wall section and extending along said second front wall section away from said first front wall section; a second section elongated back wall projecting perpendicularly from the lateral edge of each of said second section side walls remote from said second front wall section and overlying said second front wall section; a pair of first section side walls projecting perpendicularly from said one edge of said first front wall section, each of said first section side walls joining a corresponding second section side wall and extending outwardly along said first front wall section outward from said corresponding second section side wall; a first section rear wall projecting perpendicularly from the lateral edge of each first section side wall remote from said first front wall section and overlying said first front wall section;

each of said intermediate members being assembled one end of said mullion and to a corresponding one of said top and bottom breaker strip members with said intermediate member first section front, side and rear walls fitted within the front, side, rear and inner walls of the corresponding one of said top and bottom members on each side of the area from which said length of side, rear and inner walls is omitted and with said second section front, side and rear walls fitted within said front, side, rear and inner walls of said mullion.

23. A breaker strip as set forth in claim 22, wherein: each of said intermediate members includes a shoulder portion adjacent the junction of each first section side wall with the corresponding second section side wall and engaging said rear walls of each of said mullion and said corresponding one of said top and bottom members when said intermediate member is assembled to said mullion and said corresponding one of said top and bottom members.

* * * * *